US008365316B2

(12) United States Patent
Jan et al.

(10) Patent No.: US 8,365,316 B2
(45) Date of Patent: Feb. 5, 2013

(54) AIRBAG JACKET

(75) Inventors: Jin-soo Jan, Tokyo (JP); Shinichi Sugimoto, Tokyo (JP); Akifumi Takedomi, Tokyo (JP); Tadahiro Igawa, Tokyo (JP); Hiroshi Goto, Tokyo (JP); Yuki Kobayashi, Wako (JP); Masayoshi Orita, Wako (JP)

(73) Assignees: Takata Corporation, Tokyo (JP); Honda Motor Co., Ltd., Tokyo (JP)

( * ) Notice: Subject to any disclaimer, the term of this patent is extended or adjusted under 35 U.S.C. 154(b) by 458 days.

(21) Appl. No.: 12/227,636

(22) PCT Filed: Apr. 27, 2007

(86) PCT No.: PCT/JP2007/059170

§ 371 (c)(1),
(2), (4) Date: Feb. 2, 2010

(87) PCT Pub. No.: WO2007/138817

PCT Pub. Date: Dec. 6, 2007

(65) Prior Publication Data

US 2011/0047684 A1 Mar. 3, 2011

(30) Foreign Application Priority Data

Jun. 1, 2006 (JP) ..... 2006-153638

(51) Int. Cl.
*A41D 13/015* (2006.01)

(52) U.S. Cl. ..... 2/455; 2/93; 2/102; 2/463

(58) Field of Classification Search ..... 2/455, 93, 2/459, 460, 461, 462, 463, 464, 465, 102, 2/44, 45, 913, 915, DIG. 3
See application file for complete search history.

(56) References Cited

U.S. PATENT DOCUMENTS 745,007 A * 11/1903 Gamble ..... 2/462
2,663,020 A * 12/1953 Cushman ..... 2/455
(Continued)

FOREIGN PATENT DOCUMENTS

JP 01-171849 7/1989
JP 3-14605 1/1991
(Continued)

OTHER PUBLICATIONS

Office Action in JP Appln No. 2006-153638 dated May 17, 2011.

*Primary Examiner* — Khoa Huynh
*Assistant Examiner* — Andrew W Collins
(74) *Attorney, Agent, or Firm* — Foley & Lardner LLP

(57) ABSTRACT

An airbag jacket having a good fitting performance of an expanded airbag for a body in the airbag jacket where the airbag is expanded along an outer surface of the body of the wearer. An airbag 2 is provided in a manner so as to cover a waistline and both shoulders of the wearer. An inside of the airbag 2 is partitioned into a plurality of cells 2*a* by means of that an inner panel 3 constituting a first surface on a wearer side of the airbag 2 and an outer panel 4 constituting a second surface on an opposite side to the wearer is partially stitched by means of a line-shaped stitching portion 6. Each of the cells 2*a* is formed to have a shape extending in a body height direction of the wearer. Thereby, the airbag 2 is brought to be expanded along an outer surface of a body portion of the wearer as a whole.

9 Claims, 3 Drawing Sheets

U.S. PATENT DOCUMENTS

| | | | | | |
|---|---|---|---|---|---|
| 3,863,343 | A * | 2/1975 | Malmin | 433/229 |
| 4,089,065 | A * | 5/1978 | McGee | 2/456 |
| 4,637,074 | A * | 1/1987 | Taheri | 2/456 |
| 4,685,151 | A * | 8/1987 | Kincheloe | 2/456 |
| 4,825,469 | A * | 5/1989 | Kincheloe | 2/456 |
| 4,884,295 | A * | 12/1989 | Cox | 2/467 |
| 4,977,623 | A * | 12/1990 | DeMarco | 2/456 |
| 4,984,821 | A * | 1/1991 | Kim et al. | 280/728.1 |
| 5,086,514 | A * | 2/1992 | Ross | 2/467 |
| 5,746,442 | A | 5/1998 | Hoyaukin | |
| 5,867,842 | A * | 2/1999 | Pinsley et al. | 2/462 |
| 5,893,175 | A * | 4/1999 | Cooper | 2/462 |
| 5,937,443 | A * | 8/1999 | Kageyama et al. | 2/69 |
| 6,055,676 | A * | 5/2000 | Bainbridge et al. | 2/456 |
| 6,125,478 | A * | 10/2000 | Alaloof | 2/456 |
| 6,230,333 | B1 * | 5/2001 | Umeda | 2/463 |
| 7,007,307 | B2 * | 3/2006 | Takeuchi | 2/102 |
| 7,017,195 | B2 * | 3/2006 | Buckman et al. | 2/455 |
| 7,150,048 | B2 * | 12/2006 | Buckman | 2/465 |
| 2001/0049840 | A1 * | 12/2001 | Atanasio | 2/456 |
| 2003/0188371 | A1 * | 10/2003 | Duhammel et al. | 2/102 |
| 2004/0003449 | A1 | 1/2004 | Takeuchi | |
| 2004/0177425 | A1 * | 9/2004 | Kerr | 2/2.5 |
| 2006/0010588 | A1 * | 1/2006 | Schuster et al. | 2/455 |

FOREIGN PATENT DOCUMENTS

| | | |
|---|---|---|
| JP | 7-331507 | 12/1995 |
| JP | 11-36109 | 2/1999 |
| JP | 3059127 | 3/1999 |
| JP | 11-279813 | 10/1999 |
| JP | 2000-516892 | 12/2000 |
| JP | 2001-295109 | 10/2001 |
| JP | 2002-20907 | 1/2002 |
| JP | 2003-138407 | 5/2003 |
| JP | 2006/348458 | 12/2006 |
| WO | WO 99/54203 | 10/1999 |

* cited by examiner

AIRBAG JACKET

TECHNICAL FIELD

The present invention relates to an airbag jacket whose airbag is expanded along an outer surface of a body of a wearer.

BACKGROUND ART

As an airbag jacket that is worn by a rider of a two-wheeled vehicle, people aboard an airplane and a vessel, or a rider of a paraglider, or a ski racer and so forth, an airbag jacket whose airbag is expanded along an outer surface of a body of a wearer is described in Japanese Unexamined Patent Application Publication No. 2003-138407.

In the airbag jacket described in Japanese Unexamined Patent Application Publication No. 2003-138407, when the wearer encounters a collision accident, or the like, an inflator is activated and the airbag is expanded in a manner so as to wrap a body of the wearer.

[Patent Document 1] Japanese Unexamined Patent Application Publication No. 2003-138407

SUMMARY OF THE INVENTION

It is an object of the present invention to provide an airbag jacket in which an expanded airbag has a good fitting performance for a body, in the airbag jacket whose airbag is expanded along an outer surface of the body of a wearer.

An airbag jacket according to the present invention is characterized in that in an airbag jacket including an airbag that is expanded along an outer surface of a body of a wearer, the airbag includes a first surface on a body side of the wearer and a second surface on an opposite side thereto, and a gas is supplied between the first surface and the second surface, and thereby the airbag is expanded, and a limiting device for limiting a separating distance of the second surface from the first surface at a time when the airbag is expanded is provided.

BRIEF DESCRIPTION OF DRAWINGS

FIG. 1 is a horizontal cross-sectional view illustrating a state at a time when the airbag of the airbag jacket according to another embodiment is expanded.

DETAILED EXPLANATION

Figure 1B:
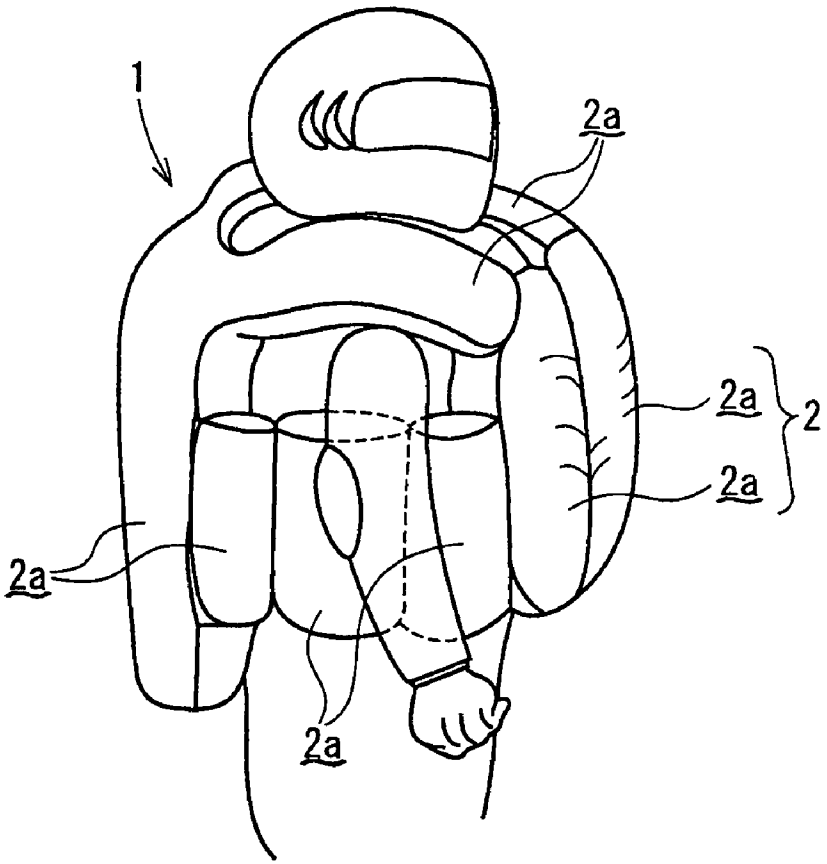
FIG. 1*a* and FIG. 1*b* are a front elevation and a perspective view, respectively, at a time of an expanding operation of an airbag, illustrating a wearer wearing an airbag jacket according to an embodiment.

An airbag jacket according to a first aspect is characterized in that in an airbag jacket including an airbag that is expanded along an outer surface of a body of a wearer, the airbag includes a first surface on a body side of the wearer and a second surface on an opposite side thereto, and a gas is supplied between the first surface and the second surface, and thereby the airbag is expanded, and a limiting device for limiting a separating distance of the second surface from the first surface at a time when the airbag is expanded is provided.

The airbag jacket according to a second aspect is characterized in that in the first aspect, the first surface and the second surface are partially connected, and thereby an inside of the airbag is partitioned into a plurality of cells, and thereby the separating distance of the second surface from the first surface at the time when the airbag is expanded is limited.

The airbag jacket according to a third aspect is characterized in that in the second aspect, a bending device for bending the airbag to have a concave curve in such a direction that the airbag surrounds the body when the airbag is expanded is provided.

The airbag jacket according to a fourth aspect is characterized in that in the third aspect, the cell is formed to have a shape extending in a longitudinal direction of the body of the wearer, and the bending device is a panel attached to the first surface of the airbag.

The airbag jacket according to a fifth aspect is characterized in that in the third aspect, the cell is formed to have a shape extending in a longitudinal direction of the body of the wearer, and the bending device is a line-shaped member extending in a direction perpendicular to the longitudinal direction of the cell, which is attached to the first surface of the airbag.

The airbag jacket according to a sixth aspect is characterized in that in any one of the first to fifth aspect, the limiting member is a tether disposed inside the airbag and coupling the front surface with the second surface.

In the airbag jacket according to the first aspect, the airbag is expanded along the outer surface of the body of the wearer when the wearer encounters a collision accident or the like. This airbag includes the first surface on the side of the body of the wearer, and the second surface on the opposite side thereto, and the airbag is expanded by means of that the gas is supplied between the first surface and the second surface.

In the first aspect, since the separating distance of the second surface from the first surface at the time when the airbag is expanded is limited by means of the limiting device, the airbag is brought to be expanded along the outer surface of the body of the wearer as a whole. Thereby, the fitting performance to the body of the wearer at the state when the airbag is expanded becomes good.

In the second aspect, the inside of the airbag is partitioned into a plurality of cells by that the first surface and the second surface are partially connected.

In the second aspect, since the first surface and the second surface are in a connected state at a portion between the adjoining cells even when the airbag, namely each cell, is expanded, the airbag can relatively be easily bent from the connected portion of the first surface and the second surface. Accordingly, the expanded airbag fits upon the outer surface of the body of the wearer.

As described in the third aspect, by means of providing the bending device for bending the airbag to have a concave curve in the direction for surrounding the body of the wearer when the airbag is expanded, the fitting performance of the expanded airbag to the body becomes good.

In this case, as described in the fourth aspect, it may be applicable to construct that each cell is formed to have a shape extending in a longitudinal direction of the body of the wearer (for example, in a body height direction of the wearer, or an extending direction of the four limbs), and a panel is attached to the first surface of the airbag facing the wearer.

As described above, by means of forming each of the cells to have a shape extending in the longitudinal direction of the body of the wearer (namely, to partition the inside of the airbag so that each cell adjoins in the direction for surrounding the body of the wearer), the expanded airbag is brought to be easily bent so that the body of the wearer is surrounded as a whole.

In addition to the above-described, by means of attaching the panel to the first surface of the airbag facing the wearer, the separating distance between each of the cells on the first surface side in the direction for surrounding the body is limited when the airbag is expanded (the separating distance between each of the cells on the first surface side becomes smaller than the separating distance between each of the cells on the second surface side opposite thereto), thereby automatically, the airbag is brought to be bent to have a concave curve in the direction for surrounding the body as a whole.

As a result, the fitting performance of the expanded airbag to the body is improved.

As described in the fifth aspect, in replacement of the panel, a line-shaped member, such as a strap, a belt, or the like that is extended in a direction to surround the body of the wearer may be provided.

In the present invention, as described in the sixth aspect, the separating distance of the second surface from the first surface at the time when the airbag is expanded may be limited by means of coupling the first surface and the second surface of the airbag by means of the tether. In the thus constructed case, by means of appropriately varying a length of the tether, a thickness of the airbag when expanded can be controlled.

Hereinbelow, an embodiment of the present invention is explained with reference to the drawings.

Figure 1A:
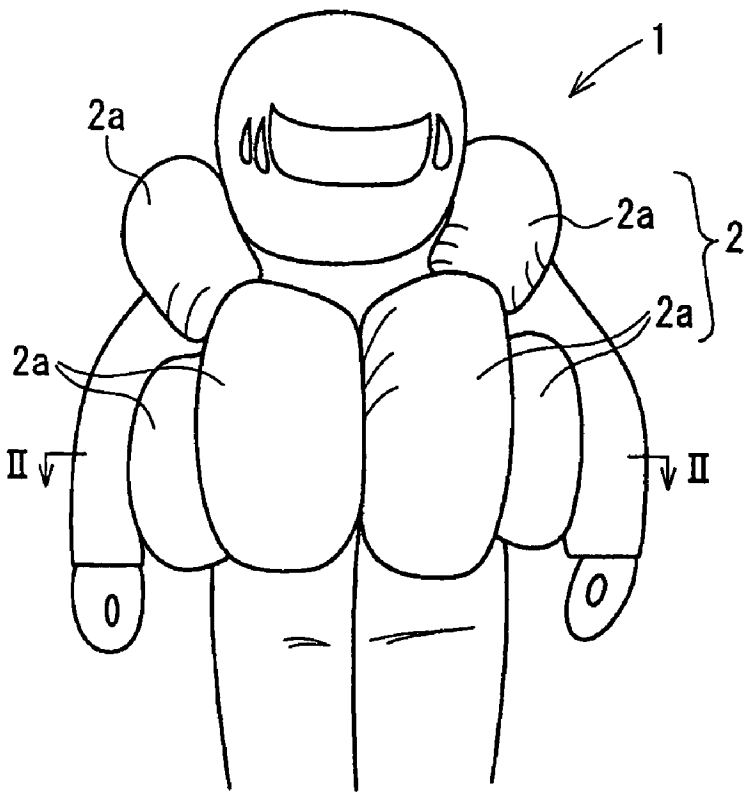
Figure 2:
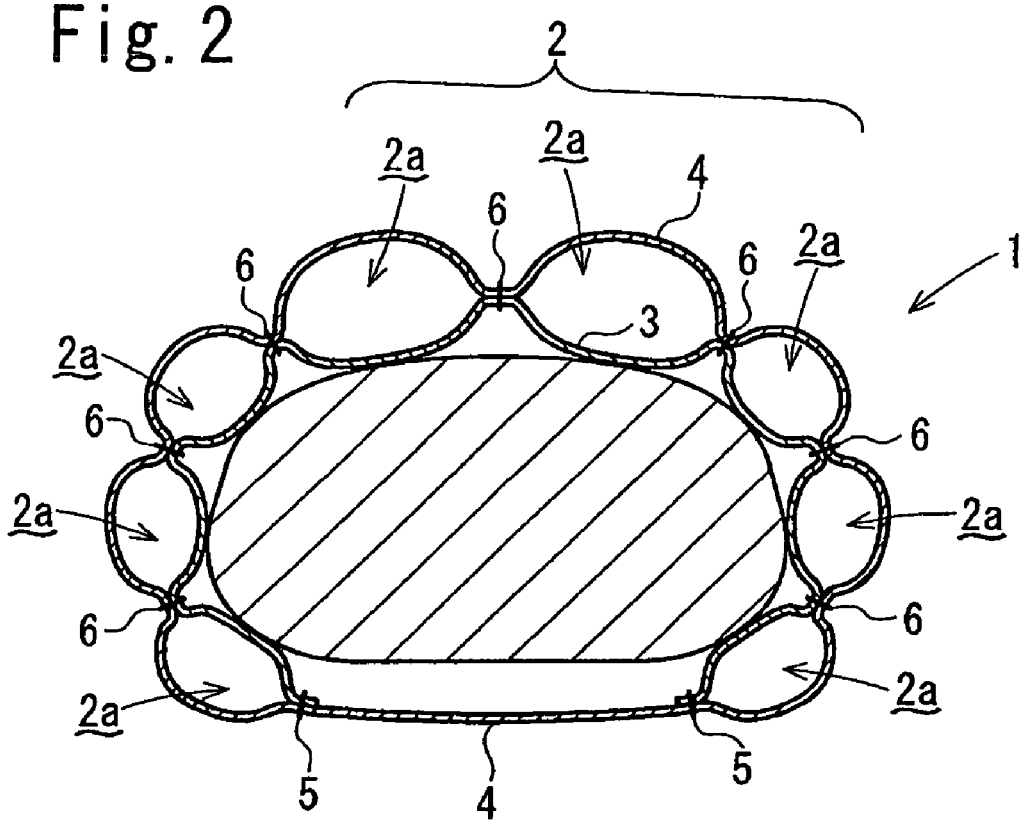
FIG. 2 is a cross-sectional view taken along a line II-II in FIG. 1*a*.

FIG. 1*a* is a front view illustrating a wearer wearing an airbag jacket according to an embodiment, and FIG. 1*b* is a perspective view illustrating the wearer, FIG. 2 is a cross-sectional view taken along a line II-II in FIG. 1*a*. Incidentally, in any of FIG. 1*a*, FIG. 1*b*, and FIG. 2, the airbag jacket is illustrated in a state where the airbag is expanded.

In this embodiment, the wearer of an airbag jacket 1 is a rider of a two-wheeled vehicle (a motorcycle or the like).

As illustrated in FIG. 1*a* and FIG. 1*b*, the airbag jacket 1 is, in this embodiment, formed of a vest shape that covers a body portion of the wearer (an upper half of the body including a chest, a belly, a back, and both shoulders, except both arms and a head portion). However, the shape of the airbag jacket of the present invention is not limited thereto, and for example, the one having sleeves for covering the both arms of the wearer may be applicable, or alternatively, the one having a jumpsuit-shape that covers a leg portion of the wearer may be applicable. The airbag jacket of the present invention may be constructed OF a jacket portion covering the upper half of the body of the wearer and a pants portion covering a lower half of the body of the wearer. Further, a neck-shaped portion for covering a neck of the wearer, or a hood-shaped portion for covering the head portion may be provided in the airbag jacket.

As illustrated in FIG. 1*a* and FIG. 1*b*, in this embodiment, an airbag 2 is provided in a manner so as to cover a waistline and both shoulders of the wearer. The airbag 2 is formed by means of stitching an inner panel 3 constituting the first surface on a wearer side thereof, and an outer panel 4 constituting the second surface on an opposite side of the wearer, and is expanded by that a gas is supplied between these panels 3 and 4, as illustrated in FIG. 2.

Incidentally, for details, the outer panel 4 surrounds an entire periphery of the body portion of the wearer and covers both shoulders from a back side to a chest side. Namely, in this embodiment, an entire envelope of the airbag jacket 1 is constructed with the outer panel 4. However, although it is natural to say, a covering operation, a coating operation for a decoration, or the like may further be performed on the outer panel 4.

The inner panel 3 is extended, as illustrated in FIG. 2, around the waistline of the wearer, from a front surface (a chest portion and a belly portion) up to before reaching a center of a back surface upon wrapping around both flanks. Further, the inner panel 3 covers both shoulders of the wearer from a both side portion of the back surface to the chest side.

The airbag 2 is formed by mean of that a peripheral edge portion of the inner panel 3 is stitched to the outer panel 4 by means of a peripheral edge-stitching portion 5 formed of a stitching thread or the like. That is, in this embodiment, in the airbag jacket 1, the airbag 2 is composed of a portion that covers both shoulders of the wearer, and a portion from a front surface of the body portion of the wearer up to a portion before reaching the center of the back surface upon wrapping around both flanks. In a back surface side of the wearer, both end sides in a body portion-surrounding direction of the airbag 2 are coupled by the outer panel 4 surrounding the entire periphery of the body portion.

Incidentally, the inner panel 3 may be configured to surround the entire periphery of the body portion of the wearer, and the outer panel 4 may be configured to be extended from the front surface of the body portion up to before reaching the center of the back surface upon wrapping around both flanks. In this case, both end sides in the surrounding direction of the body portion of the wearer of the airbag 2 are coupled by means of the inner panel 3. However, the airbag 2 may be formed across the entire periphery of the body portion of the wearer.

In this embodiment, the inner panel 3 and the outer panel 4 are partially stitched by means of a line-shaped stitching portion 6 in an inside area relative to the peripheral edge portion of the inner panel 3. An inside of the airbag 2 is partitioned into a plurality of cells 2*a* by means of the line-shaped stitching portion 6.

As illustrated in FIG. 1*a* and FIG. 1*b*, in this embodiment, a plurality of line-shaped stitching portions 6 is extended in a height direction (upper and lower direction) of the wearer, respectively, while being spaced apart at intervals in such a direction that the airbag surrounds the body portion of the wearer. Thereby, a plurality of cells 2*a* are formed in a manner so as to adjoin in the surrounding direction of the body portion of the wearer, and each of the cells 2*a* is formed to have a shape extending in a body height direction of the wearer.

In this embodiment, a limiting device for limiting a separating distance between the outer panel 4 and the inner panel 3 at a time when the airbag 2 is expanded is constructed by means of the line-shaped stitching portion 6.

Incidentally, in each of the line-shaped stitching portions 6, both end sides thereof are separated from the peripheral-edge stitching portion 5, or discontinued halfway, or the like, and thereby each of adjoining cells 2*a* and 2*a* is allowed to communicate with each other.

Although not illustrated, in the airbag jacket 1, an inflator for expanding the airbag 2 and a control circuit for the inflator are provided. A collision-detection or prognosis sensor that is mounted on a vehicle body of a two-wheeled vehicle is connected to the control circuit, and when the sensor detects or prognoses the collision of the two-wheeled vehicle, a collision detection or prognosis signal is transmitted to the control circuit from the sensor, and the control circuit activates the inflator on the basis of this signal.

Next, an operation of the airbag jacket 1 having such a construction is explained.

When a collision of the two-wheeled vehicle driven by the wearer who wears the airbag jacket 1 is detected or prognosed by means of the aforementioned collision-detection or prognosis sensor, the aforementioned controller activates the inflator on the basis of the signal from the sensor, and a gas is supplied from the inflator into the airbag 2 and the airbag 2 is expanded. The airbag 2 is expanded in a manner so as to wrap the body portion of the wearer as illustrated in FIGS. 1*a* and 1*b*, and an impact is prevented or suppressed from being applied to the body portion of the wearer.

In the airbag jacket 1, since the inner panel 3 and the outer panel 4 are partially connected by means of the line-shaped stitching portion 6 on an inside relative to the peripheral edge portion of the inner panel 3, and thereby the inside of the airbag 2 is partitioned into a plurality of cells 2*a*, the airbag 2 is brought to be expanded along an outer surface of the body portion of the wearer as a whole. Therefore, a fitting performance to the body portion of the wearer at the time when the airbag 2 is expanded is good.

Further, in this embodiment, since each of the panels 3 and 4 are connected by means of the line-shaped stitching portion 6 between each of the adjoining cells 2*a* and 2*a*, even when the airbag 2, namely each of the cells 2*a* is expanded, the airbag 2 can be easily bent from each of the line-shaped stitching portions 6. Specifically, in this embodiment, since each of the line-shaped stitching portions 6 is extended in the body height direction of the wearer, and each of the cells 2*a* and 2*a* adjoins in the direction for surrounding the body portion of the wearer, the expanded airbag 2 is easy to be bent in a manner so as to surround the body portion of the wearer. As a result, a fitting performance of the expanded airbag 2 to the body portion becomes good.

Figure 3:
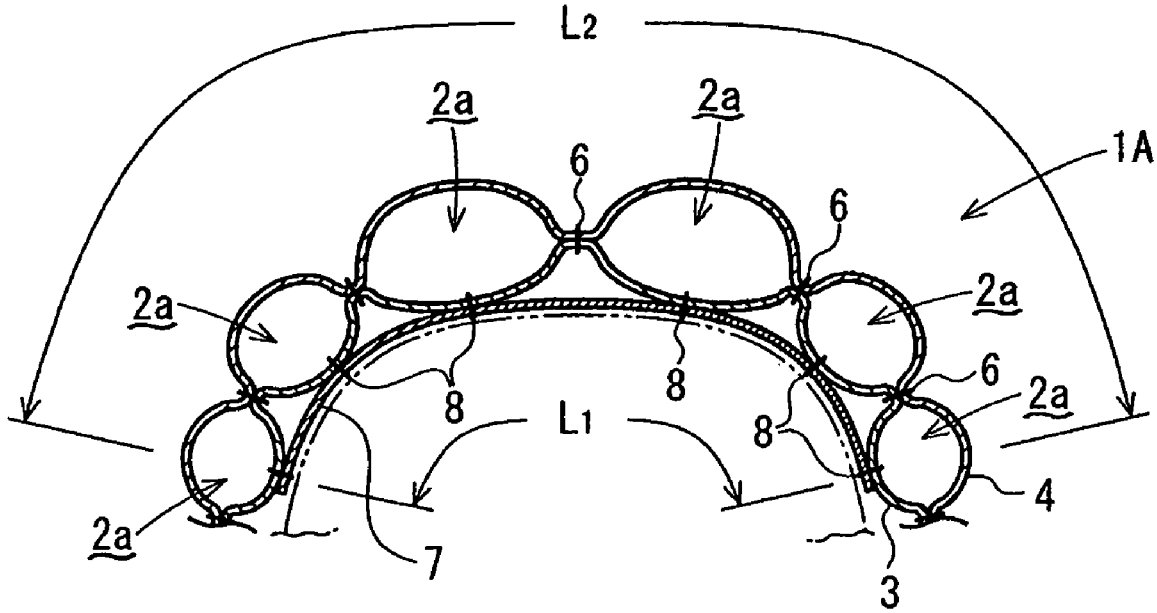

FIG. 3 is a horizontal cross-sectional view illustrating a state when the airbag of the airbag jacket according to another embodiment is expanded.

An airbag jacket 1A according to this embodiment is constructed such that in the airbag jacket 1 in the aforementioned FIG. 1*a*, FIG. 1*b*, and FIG. 2, a panel 7 serving as a bending device for bending the airbag 2 to have a concave curve in the direction for surrounding the body portion of the wearer when the airbag 2 is expanded, is disposed between the airbag 2 and the body portion of the wearer, and that the panel 7 is stitched to an outer surface of the inner panel 3 by means of a stitching portion 8.

For details, in this embodiment, the panel 7 has a size extending from the front surface of the body portion of the wearer (illustrated in FIG. 3 by a chain double-dashed line) up to both flanks. In the inner panel 3, a portion constituting a surface on the wearer side of each of the cells 2*a* (six in number in this embodiment) that is continuously disposed from the front surface of the body portion of the wearer up to both flanks is respectively coupled with the panel 7 by means of the stitching portion 8.

As illustrated in FIG. 3, a distance between each of the stitching portions 8 and 8 of each of the inner panels 3 and the panel 7 between the adjoining cells 2*a* and 2*a* is set to be smaller than a distance between each of the cells 2*a* and 2*a* on the outer panel 4 side when the airbag 2 is expanded. In FIG. 3, in the six cells 2*a* coupled with the panel 7, a distance $L_1$ from the stitching portion 8 of the inner panel 3 of the cell 2*a* and the panel 7 positioned at one end side, up to the stitching portion 8 of the inner panel 3 and the panel 7 of the cell 2*a* positioned on the other end side, is set to be smaller than a distance $L_2$ on the outer panel 4 side from the cell 2*a* positioned on the one end side up to the cell 2*a* positioned on the other end side when the airbag 2 is expanded.

Incidentally, in this embodiment, although the continuing six cells 2*a* are coupled with a panel 7 of one sheet, the number of the cells 2*a* that is coupled with the panel 7 of one sheet is not limited thereto. Continuing five or less in number, or seven or more in number of the cells 2*a* may be coupled with the panel 7 of one sheet. However, in the continuing cells 2*a*, a cell 2*a* that is not coupled with the panel 7 may be present. It may be applicable that a plurality of sheets of the panels 7 is disposed while displacing a position of thereof in a surrounding direction of the body portion of the wearer, and that a plurality of number of the cells 2*a* is coupled with each of the panels 7.

A construction of the airbag jacket 1A other than the above-described is identical of that of the airbag jacket 1 in FIG. 1*a*, FIG. 1*b*, and FIG. 2, and in FIG. 3, the same numerals as that in FIG. 1*a*, FIG. 1*b*, and FIG. 2 denote the same elements.

In the airbag jacket 1A, each of the cells 2*a* of the airbag 2 also has a shape extending in the body height direction of the body of the wearer. That is, each of the cells 2*a* adjoins in the direction for surrounding the body portion of the wearer. Thereby, the expanded airbag 2 is easy to be bent in a manner so as to surround the body of the wearer as a whole.

In addition to the above, in the airbag jacket 1A, on an inner panel 3 side of the airbag 2, the panel 7 for coupling each of the cells 2*a* is attached and thereby when the airbag 2 is expanded, a separating distance in the direction for surrounding the body portion of each of the cells 2*a* on the inner panel 3 side is limited. That is, the separating distance $L_1$ between each of the cells 2*a* on the inner panel 3 side is brought to be smaller than a separating distance $L_2$ between each of the cells 2*a* and 2*a* on the outer panel 4 side opposite thereto. Therefore, automatically, the airbag 2 is brought to be bent to have a concave curve in the direction for surrounding the body portion as a whole.

As a result, the fitting performance of the expanded airbag 2 to the body becomes good.

Incidentally, in the present invention, in replacement of the panel 7, each of the adjoining cells 2*a* and 2*a* may be coupled on the inner panel 3 side using a line-shaped member such as a strap, a belt, a wire, or the like.

Figure 4:
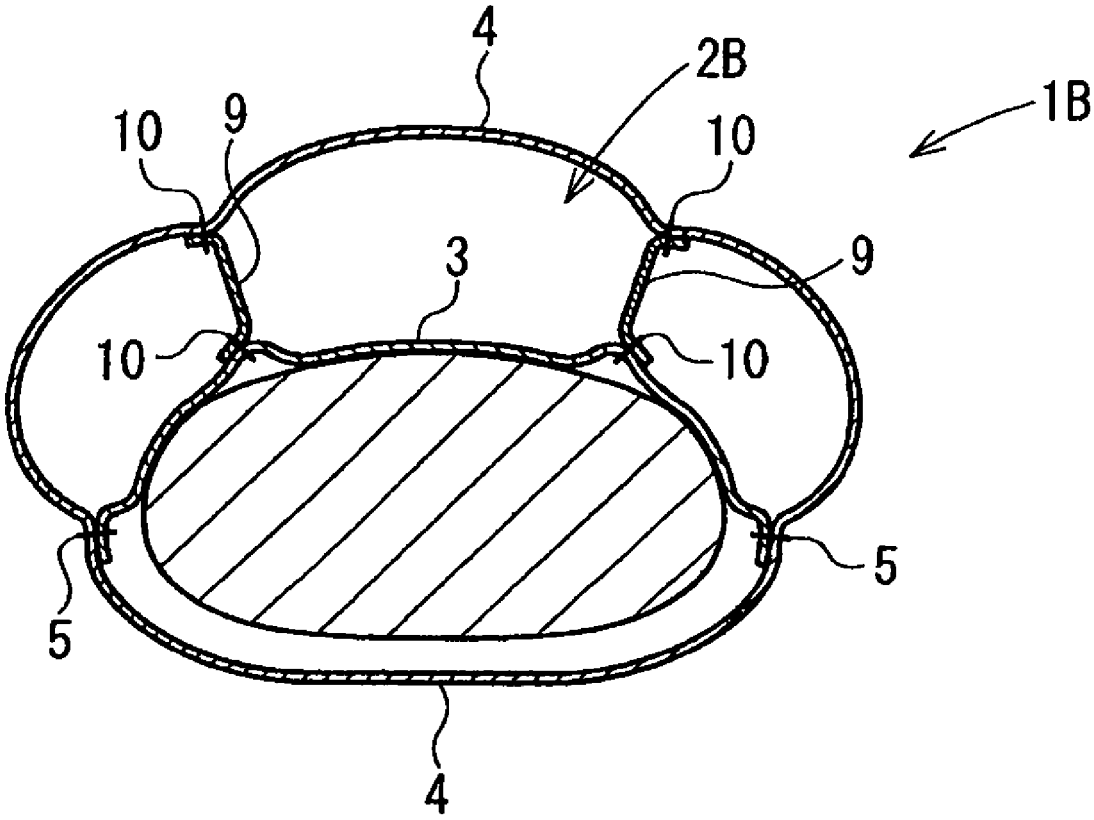
FIG. 4 is a horizontal cross-sectional view illustrating a state at a time when the airbag of the airbag jacket according to still another embodiment is expanded.

FIG. 4 is a horizontal cross-sectional view illustrating a state when an airbag of an airbag jacket according to still another embodiment is expanded.

An airbag 2B of an airbag jacket 1B in this embodiment is constructed such that in the airbag 2 of the airbag jacket 1 in the above-described FIG. 1*a*, FIG. 1*b*, and FIG. 2, in replacement of connecting the inner panel 3 on the wearer side and the outer panel 4 on the opposite side by means of the line-shaped connecting portion 6, the same are coupled by a tether 9. A numeral 10 denotes a stitching portion connecting both end sides of the tether 9 to the inner panel 3 and the outer panel 4, respectively.

Incidentally, in this embodiment, although two tethers 9 are provided while leaving a space in the direction for surrounding the body portion of the wearer, the number and the disposition (a coupling position of the inner panel 3 and the outer panel 4) of the tether 9 is not limited thereto.

A construction of the airbag jacket 1B other than the above-described is identical of that of the airbag jacket 1 in the above-describe FIG. 1*a*, FIG. 1*b*, and FIG. 2, and in FIG. 4, the same numerals as that in FIG. 1*a*, FIG. 1*b*, and FIG. 2 denote the same elements.

In the airbag jacket 1B having a construction as described above, since the inner panel 3 constituting a first surface on the wearer side of the airbag 2B, and the outer panel 4 constituting a second surface on the opposite side there to are also coupled by means of the tether 9, a separating distance between the outer panel 4 and the inner panel 3 at a time when the airbag 2B is expanded is limited, and the airbag 2B is brought to be expanded along the outer surface of the body of the wearer as a whole. Thereby, a fitting performance of the expanded airbag 2B to the body becomes good.

Incidentally, in this airbag jacket 1B, a thickness of the expanded airbag 2B can also be controlled by means of appropriately varying a length of the tether 9.

Any of the aforementioned embodiments is illustrative of the present invention, and the aforementioned each of the embodiments is not to be construed as limiting the present invention.

For example, in each of the aforementioned embodiments, although the wearer of the airbag jacket of the present invention is the rider of the two-wheeled vehicle, the wearer may be a human body other than that.

Incidentally, the present application is based on Japanese Patent Application (Japanese Patent Application No. 2006-153638) filed Jun. 1, 2006, the entire contents of which are incorporated by reference.

The invention claimed is:

1. An airbag jacket comprising:

an airbag that is expanded along an outer surface of a body of a wearer, the airbag including an inner panel constituting a first surface on a body side of the wearer and an outer panel constituting a second surface on an opposite side thereto, the outer panel comprising a single continuous envelope of material with a uniform thickness;

a gas supplied between the first surface and the second surface, the gas configured to expand the airbag; and a limiting device configured to limit a separating distance of the second surface and the first surface at a time when the airbag is expanded, wherein the outer panel surrounds an entire periphery of the body of the wearer in a direction crossing a longitudinal direction of the body, wherein the outer panel has a first area for forming the airbag and a second area where the airbag is not formed, and the inner panel is only disposed at the first area of the outer panel, and wherein a periphery of the inner panel is sewed to the outer panel.

2. The airbag jacket according to claim 1, wherein the first surface and the second surface are partially connected, and thereby an inside of the airbag is partitioned into a plurality of cells, and thereby the separating distance of the second surface from the first surface at the time when the airbag is expanded is limited.

3. The airbag jacket according to claim 2, wherein a bending device for bending the airbag to have a concave curve in such a direction that the airbag surrounds the body when the airbag is expanded is provided.

4. The airbag jacket according to claim 3, wherein the cell is formed to have a shape extending in a longitudinal direction of the body of the wearer, and the bending device is a panel attached to the first surface of the airbag.

5. The airbag jacket according to claim 3, wherein the cell is formed to have a shape extending in a longitudinal direction of the body of the wearer, and the bending device is a line-shaped member extending in a direction perpendicular to the longitudinal direction of the cell, which is attached to the first surface of the airbag.

6. The airbag jacket according to claim 1, wherein the limiting member is a tether disposed inside the airbag and coupling the front surface with the second surface.

7. The airbag jacket according to claim 4, wherein the panel is disposed across two or more cells adjoining in a direction perpendicular to the longitudinal direction of the body of the wearer, and is respectively connected to the first surface of the cells positioned at least both ends thereof, and wherein between each of the cells coupled by the panel, a distance between each of the connecting portions of the cells and the panel is set to be smaller than a distance between each of the cells on the second surface side at a time when the airbag is expanded.

8. The airbag jacket according to claim 5, wherein the line-shaped member is disposed across two or more cells adjoining in the direction perpendicular to the longitudinal direction of the body of the wearer, and is respectively connected to the first surface of the cells positioned on at least both ends thereof, and wherein between each of the cells coupled by the line-shaped member, a distance between each of the connecting portions of the cells and the line-shaped member is set to be smaller than a distance between each of the cells on the second surface side at a time when the airbag is expanded.

9. The airbag jacket according to claim 1, wherein the airbag is formed by stitching an inner panel constituting the first surface and an outer panel constituting the second surface, and wherein at least one of the inner panel and the outer panel surrounds the body of the wearer across an entire periphery in the direction perpendicular to the longitudinal direction thereof.

* * * * *

UNITED STATES PATENT AND TRADEMARK OFFICE

CERTIFICATE OF CORRECTION

PATENT NO. : 8,365,316 B2
APPLICATION NO. : 12/227636
DATED : February 5, 2013
INVENTOR(S) : Jan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 560 days.

Signed and Sealed this
Thirteenth Day of August, 2013

Teresa Stanek Rea
*Acting Director of the United States Patent and Trademark Office*